US009536487B2

(12) United States Patent
Imayoshi

(10) Patent No.: US 9,536,487 B2
(45) Date of Patent: Jan. 3, 2017

(54) SEMICONDUCTOR DEVICE, DISPLAY DEVICE, AND SIGNAL LOADING METHOD

(71) Applicant: LAPIS SEMICONDUCTOR CO., LTD., Yokohama-Shi, Kanagawa (JP)

(72) Inventor: Takahiro Imayoshi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 22 days.

(21) Appl. No.: 14/307,119

(22) Filed: Jun. 17, 2014

(65) Prior Publication Data

US 2014/0375626 A1 Dec. 25, 2014

(30) Foreign Application Priority Data

Jun. 20, 2013 (JP) ..... 2013-129919

(51) Int. Cl.
*G09G 3/36* (2006.01)

(52) U.S. Cl.
CPC ..... *G09G 3/3688* (2013.01); *G09G 2310/06* (2013.01); *G09G 2370/08* (2013.01); *G09G 2370/14* (2013.01)

(58) Field of Classification Search
CPC ..... G09G 2370/14
See application file for complete search history.

(56) References Cited

U.S. PATENT DOCUMENTS

2005/0088432 A1* 4/2005 Miyazawa ..... G09G 3/3648 345/204
2009/0303224 A1* 12/2009 Yoshida ..... G09G 3/3648 345/213
2010/0118221 A1* 5/2010 Kim ..... G02F 1/136286 349/39
2013/0103994 A1* 4/2013 Tekumalla ..... G01R 31/318594 714/726

FOREIGN PATENT DOCUMENTS

JP 02-044828 2/1990
JP 2002-311912 10/2002
JP 2012-44256 3/2012

* cited by examiner

*Primary Examiner* — Kathy Wang-Hurst
*Assistant Examiner* — Matthew Yeung
(74) *Attorney, Agent, or Firm* — Volentine & Whitt, PLLC

(57) ABSTRACT

A drive IC, a display device and a loading method enable signals of different differential formats to be loaded without resulting in circuit redundancy. A drive IC includes an input section, a holding section, a selection section, and an output section. The input section includes a first input circuit and a second input circuit. When data of RSDS format is loaded, a selection section selects for output to the output section data held in a holding section that temporarily stores data output from the input section. When mini-LVDS format data is loaded, the selection section selects the data output from the input section for output to the output section. When the mini-LVDS data is loaded, a switch switches the output destination of the output section, such that data is rearranged in the desired sequence and externally output.

12 Claims, 10 Drawing Sheets

DISPLAY DEVICE 80

SEMICONDUCTOR DEVICE, DISPLAY DEVICE, AND SIGNAL LOADING METHOD

CROSS-REFERENCE TO RELATED APPLICATION

This application claims priority under 35 USC 119 from Japanese Patent Application No. 2013-129919, filed on Jun. 20, 2013, the disclosure of which is incorporated by reference herein.

BACKGROUND OF THE INVENTION

Field of the Invention

The present invention relates to a semiconductor device, a display device, and a signal loading method.

Description of the Related Art

ICs are generally provided with an interface to load input signals. Such ICs include, for example, drive ICs employed to display an image on a display panel such as a liquid crystal display. Drive ICs have a function of receiving, from a timing controller semiconductor device, a data signal and a control signal for displaying an image on a display panel, for outputting to a signal line of the display panel.

As an example of a drive IC, Japanese Patent Application Laid-Open (JP-A) No. 2012-44256 describes a semiconductor circuit that is capable of loading, according to signal input format, signals input using different formats, a single-ended input format and a different differential input format.

JP-A No. 2002-311912 describes a liquid crystal display device in which flip flops are disposed in a multi-stage bifurcated style layout, with the operating cycle of the flip flops disposed in each respective stage of the multi-stage halving at each stage from an input stage to an output stage.

JP-A No. H02-44828 describes a technology in which data is latched at the rising edge and falling edge of a clock signal, and two types of data, latched either at a timing of the rise or a timing of the fall of the clock signal (two types of data latched at the rising edge and the falling edge of the clock signal), are output at the same time.

In general, input methods for data (information) input to a drive IC from a timing controller semiconductor device mainly employ differential input formats. For example, reduced Swing Differential Signaling (RSDS) and mini-Low Voltage Differential Signaling (mini-LVDS) are examples of differential input method standards.

Recently, greater speed, as well as compatibility with mini-LVDS interfaces that are faster than RSDS interfaces, are being demanded of IC interfaces.

JP-A Nos. 2012-44256, 2002-311912, and H02-44828 make no reference to loading signals of different differential input formats. The technology described in JP-A No. 2012-44256 is capable of accommodating two formats, a single input format and a differential input format, but is unable to accommodate different differential input formats (such as RSDS and mini-LVDS). Generally, conventional drive ICs do not include functionality for inputs of different differential input formats.

There is consequently a need to redesign drive ICs for each type of signal output from a timing controller, incurring a lengthy development process and redesign costs. An existing solution involves providing a drive IC with circuits corresponding to both of the different differential input signal formats and using a select signal, for example, to select one or other of the circuits for use. However, such a solution leads to the unused circuit becoming redundant.

SUMMARY OF THE INVENTION

The present invention provides a semiconductor device, a display device, and a signal loading method that enable signals of different differential input formats to be loaded without circuit redundancy.

A first aspect of the present invention is a semiconductor device including: an input section that is input with one out of a first differential signal or a second differential signal different to the first differential signal, and that loads the input first differential signal, or the input second differential signal, according to a first clock signal and outputs the loaded signal; a holding section that loads the first differential signal that has been output from the input section according to a second clock signal, and holds and then outputs the loaded signal; a selection section that, for output to an output section that loads the first differential signal or the second differential signal according to a third clock signal and outputs the loaded signal, selects the first differential signal that has been output from the holding section in a case in which the first differential signal has been input to the input section, and selects the second differential signal that has been output from the input section for output to the output section in a case in which the second differential signal has been input to the input section; and a clock signal supply section that supplies to the output section the third clock signal corresponding to the first differential signal or the second differential signal that has been input to the input section.

Another aspect of the present invention is a display device including: a display panel; a drive IC that includes the semiconductor device according to the first aspect, the drive IC outputting to the display panel a signal generated based on image data that is the first differential signal or the second differential signal loaded by the semiconductor device; and a timing controller that instructs the semiconductor device regarding loading of the image data.

Still another aspect of the present invention is a signal loading method including: inputting, by an input section, one out of a first differential signal or a second differential signal different to the first differential signal, and loading the input first differential signal, or the input second differential signal, according to a first clock signal and outputting the loaded signal; loading, by a holding section, the first differential signal that has been output from the input section according to a second clock signal, and holding and then outputting the loaded signal; selecting, by a selection section, for output to an output section that loads the first differential signal or the second differential signal according to a third clock signal and outputs the loaded signal, the first differential signal that has been output from the holding section in a case in which the first differential signal has been input to the input section, and selecting the second differential signal that has been output from the input section for output to the output section in a case in which the second differential signal has been input to the input section; and supplying, by a clock signal supply section, the third clock signal corresponding to the first differential signal or the second differential signal that has been input to the input section to the output section.

The present invention provides a semiconductor device, a display device, and a signal loading method that may load signals of different differential input formats without circuit redundancy.

BRIEF DESCRIPTION OF THE DRAWINGS

Embodiments of the invention will be described in detail with reference to the following figures, wherein.

DETAILED DESCRIPTION OF THE INVENTION

Detailed explanation follows regarding an exemplary embodiment with reference to the drawings.

A semiconductor device of the present exemplary embodiment loads signals of different differential input formats and outputs signals to another circuit (such as an internal circuit) mounted to an IC, or the like, that incorporates the semiconductor device. Namely, the semiconductor device functions as an interface that accommodates signals of respective different input differential input formats. By way of a specific example, in the present exemplary embodiment the input is either a differential signal corresponding to a Reduced Swing Differential Signaling (RSDS) format, or a differential signal corresponding to a mini-Low Voltage Differential Signaling (mini-LVDS). Explanation follows regarding a case in which the semiconductor device functions as either an RSDS interface or a mini-LVDS interface.

Figure 1:
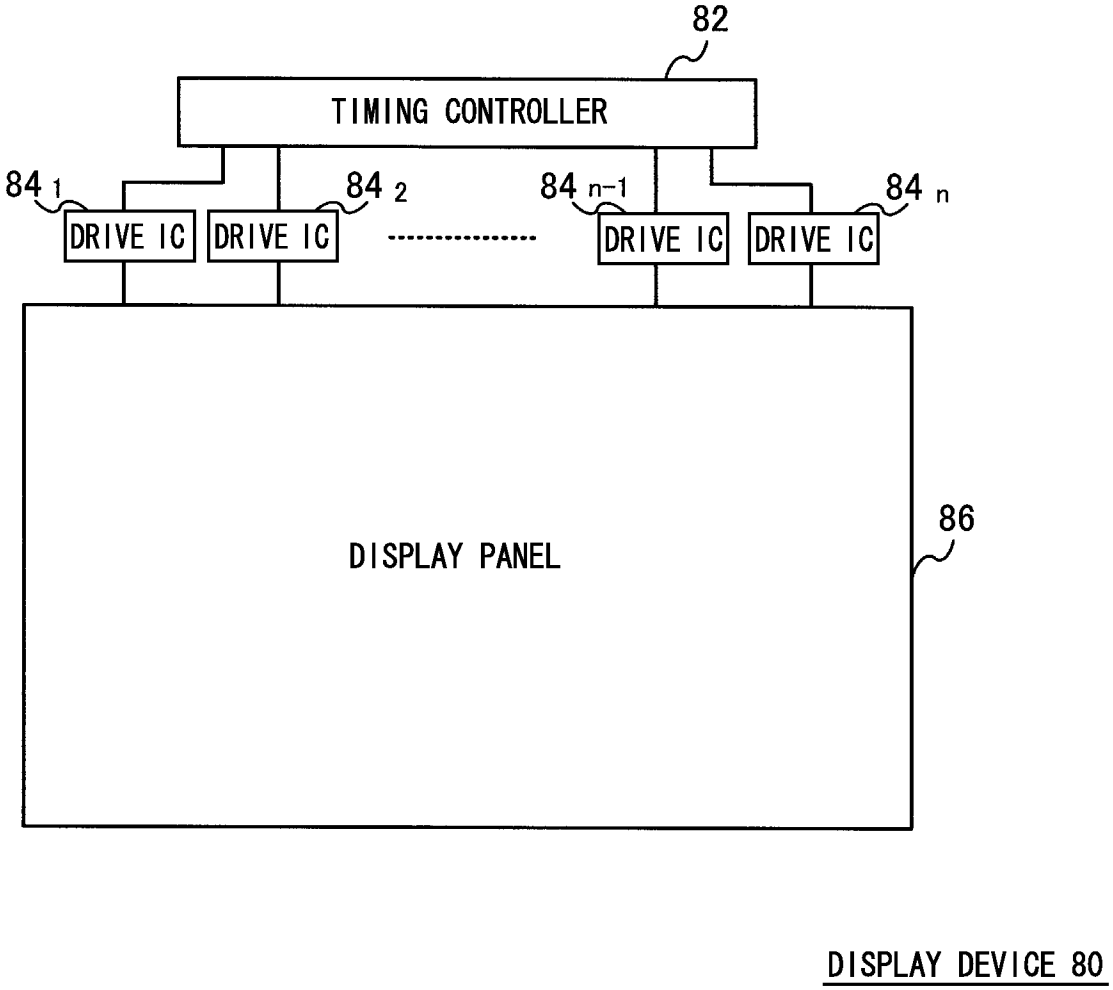
FIG. 1 is a configuration diagram illustrating configuration of a display device of a present exemplary embodiment.

Explanation follows regarding a display device with the semiconductor device of the present exemplary embodiment applied as a drive IC interface. FIG. 1 is a configuration diagram illustrating a configuration example of a display device of the present exemplary embodiment. As illustrated in FIG. 1, a display device 80 of the present exemplary embodiment includes a timing controller 82, n individual drive ICs 84 ($\mathbf{84}_1$ to $\mathbf{84}_n$), and a display panel 86.

The display panel 86 is, for example, a liquid crystal display.

Data signals and control signals for displaying an image on the display panel 86 are input from the timing controller 82 to the drive ICs 84. A semiconductor device 10 functions as an interface in each of the drive ICs 84, and is capable of loading the data signals and control signals from the timing controller 82. Accordingly, each of the drive ICs 84 of the present exemplary embodiment is capable of using the semiconductor device 10 to load both RSDS format differential input signals (referred to below as RSDS format data) and mini-LVDS format differential input data (referred to below as mini-LVDS format data). Each of the drive ICs 84 performs specific processing based on the loaded signals from the timing controller 82 using a later stage circuit (not illustrated in the drawings) of the semiconductor device 10, and outputs to signal lines of the display panel 86.

In the display device 80 of the present exemplary embodiment, the drive ICs 84 are thus capable of loading both RSDS format data and mini-LVDS format data, thereby enabling data (differential input signals) to be loaded appropriately, regardless of whether the output of the timing controller 82 is in an RSDS format or a mini-LVDS format.

Figure 2:
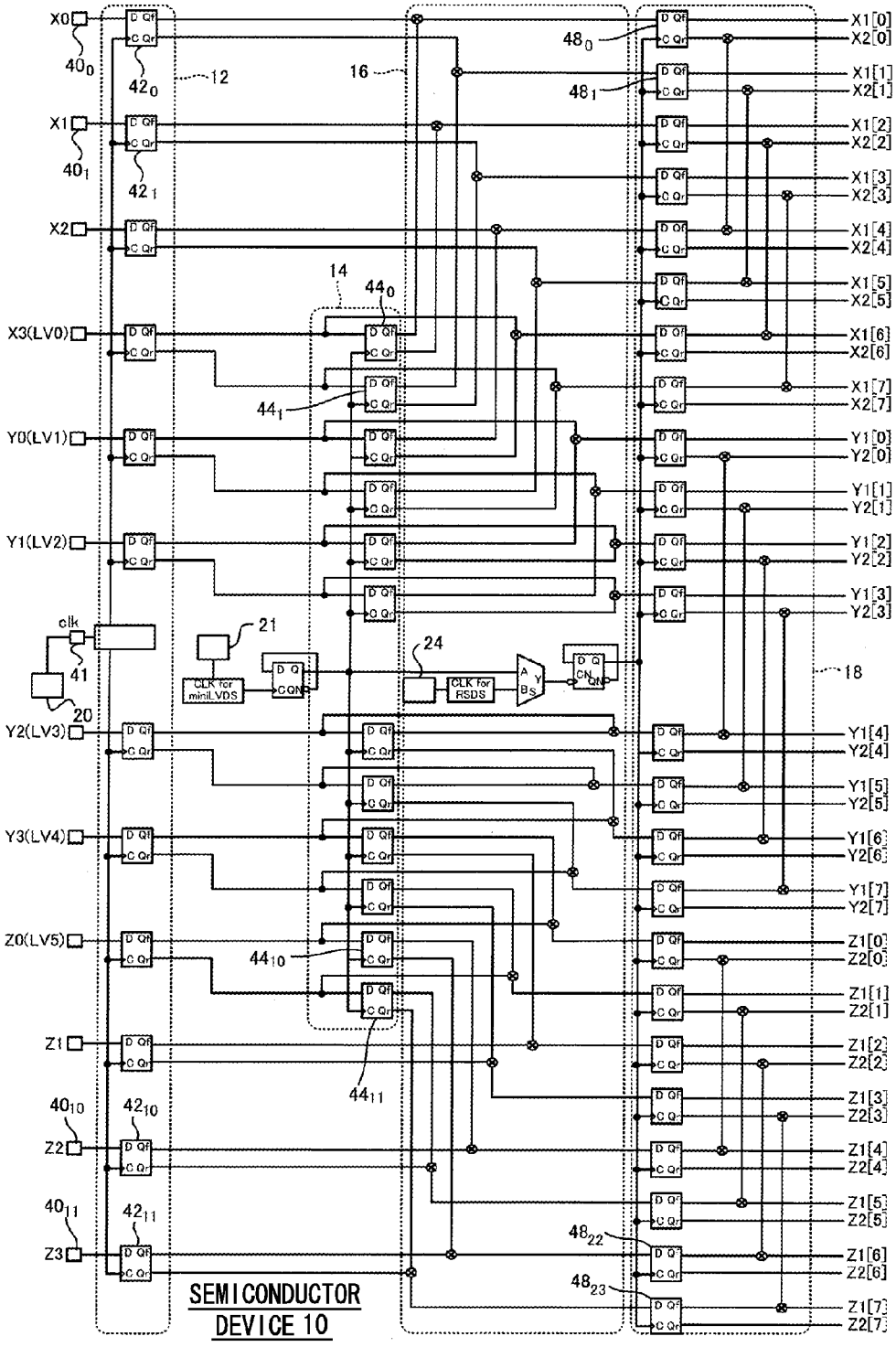
FIG. 2 is a circuit diagram illustrating overall configuration of a semiconductor device of the present exemplary embodiment.
Figure 3:
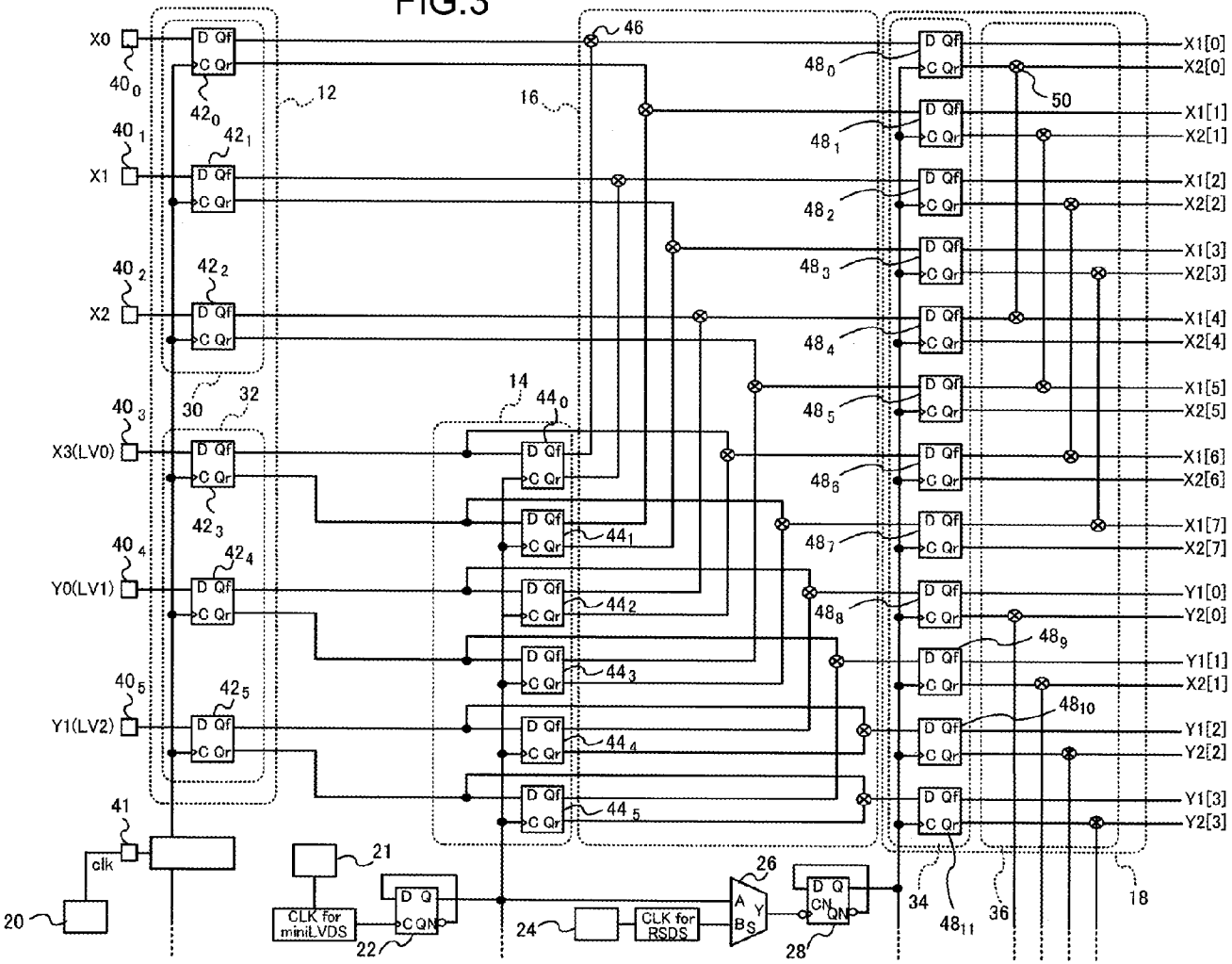
FIG. 3 is a circuit diagram illustrating a portion of the semiconductor device illustrated in FIG. 2 in greater detail.

Explanation follows regarding configuration of the semiconductor device 10 of the present exemplary embodiment, with reference to the drawings. FIG. 2 illustrates a circuit diagram of an example of an overall configuration of the semiconductor device of the present exemplary embodiment. FIG. 3 illustrates a circuit diagram showing a portion of the semiconductor device illustrated in FIG. 2 in greater detail. As illustrated in FIG. 2, the semiconductor device 10 of the present exemplary embodiment is configured with three semiconductor devices connected in parallel to configure one circuit block. The number of bits of data output by one circuit block depends on the display panel 86. The display panel 86 is configured by pixels, with each pixel configured from plural sub-pixels for color display. In order for each circuit block of the semiconductor device 10 of the present exemplary embodiment to output two pixels worth at a time of data for each sub-pixel to display an image on the display panel 86, there are 3 sub-pixels when employing the three primary colors RGB, resulting in a multiple of 3 primary colors (=3 sub-pixels)×2 pixels=a multiple of 6. The semiconductor device 10 of the present exemplary embodiment employs 8-bit data as gradations of each color (256 gradations), and therefore functions to output 3 primary colors×2 pixels×8 bits=48 bit data.

The semiconductor device 10 of the present exemplary embodiment includes an input section 12, a holding section 14, a selection section 16, an output section 18, and an RSDS clock signal supply section 24.

In the present exemplary embodiment, the semiconductor device 10 is externally provided with a clock signal supply section 20 that supplies an RSDS reference clock signal clk and a mini-LVDS reference clock signal clk. The clock signals are externally supplied to the input section 12 through a terminal 41. The input section 12 loads RSDS format data or mini-LVDS format data according to the reference clock signal clk supplied from the clock signal supply section 20, and outputs the loaded data.

The input section 12 includes a first input circuit 30 and a second input circuit 32, and is configured from D flip flop circuits 42 ($\mathbf{42}_0$ to $\mathbf{42}_{11}$). The D flip flop circuits 42 ($\mathbf{42}_0$ to $\mathbf{42}_2$, $\mathbf{42}_9$ to $\mathbf{42}_{11}$) of the first input circuit 30 are input with RSDS format data through respective input terminals 40 ($\mathbf{40}_0$ to $\mathbf{40}_2$, $\mathbf{40}_9$ to $\mathbf{40}_{11}$). The first input circuit 30 is connected to the output section 18 through the selection section 16, and the loaded RSDS format data is output to the output section 18.

The D flip flop circuits 42 ($\mathbf{42}_3$ to $\mathbf{42}_8$) of the second input circuit 32 are input with RSDS format data and mini-LVDS format data through the respective input terminals 40 ($\mathbf{40}_3$ to $\mathbf{40}_8$). The second input circuit 32 is connected to the output section 18 through the holding section 14 and the selection section 16. The second input circuit 32 outputs the RSDS format data to the output section 18 through the selection section 16 when RSDS format data has been loaded. The second input circuit 32 outputs the mini-LVDS format data to the holding section 14 when mini-LVDS format data has been loaded.

The holding section 14 loads the mini-LVDS format data output from the second input circuit 32 according to a clock signal clk2 of half the frequency of a clock signal clk supplied from a clock signal supply section 21, and outputs the loaded data to the output section 18. The holding section 14 is connected to D flip flop circuits 48 ($\mathbf{48}_0$ to $\mathbf{48}_{23}$).

The selection section 16 is specifically a selector or the like. When the selection section 16 is input with RSDS format data, the selection section 16 selects the RSDS format data output from the input section 12 and outputs the RSDS format data to the output section 18. When the selection section 16 is input with mini-LVDS format data, the selection section 16 selects the mini-LVDS format data output from the holding section 14 and outputs the mini-LVDS format data to the output section 18. Note that, in the present exemplary embodiment, control of which type of data (differential signal) has been input, or which type to switch to, is performed according to externally input control signals (not illustrated in the drawings).

The output section 18 has a function of outputting the RSDS format data and the mini-LVDS format data input from the selection section 16 to outside the semiconductor device 10. The output section 18 includes an output circuit 34 and a switch 36. The output circuit 34 includes D flip flop circuits 48 ($\mathbf{48}_0$ to $\mathbf{48}_{23}$). The output circuit 34 is connected to the selection section 16, and loads RSDS format data and mini-LVDS format data corresponding to the data type (RSDS format or mini-LVDS format) according to the clock signal clk2 or a clock signal clk4, and outputs the loaded data. The RSDS format data is externally output from the semiconductor device 10 as it is. However, the output destination of mini-LVDS format data is switchable by the switch 36. When outputting mini-LVDS format data, the output section 18 of the present exemplary embodiment accordingly has a function of switching the output destination (rearranging the output sequence) using the switch 36, and outputting. A specific example of the switch 36 a crossbar switch or the like. In the present exemplary embodiment, control and the like of the switch 36 is performed according to externally input control signals (not illustrated in the drawings), similarly to in the selection section 16.

The clock signal supply section 20 that is provided externally to the semiconductor device 10 inputs the reference clock signal clk to the terminal 41 according to the input data type. The clock signal supply section 21 supplies a clock signal clk that has the same speed (frequency) as the reference clock signal clk that is input to the terminal 41, compatible with mini-LVDS format data. A D flip flop circuit 22 halves the frequency of the reference clock signal clk supplied by the clock signal supply section 21 to give a clock signal clk2, and the clock signal clk2 is supplied to D flip flop circuits 44 of the holding section 14.

The clock signal supply section 24 supplies a clock signal clk that has the same speed (frequency) as the reference clock signal clk that is input to the terminal 41, compatible with RSDS format data.

A multiplexer 26 selects between the mini-LVDS clock signal clk2 (input A) and the RSDS clock signal clk (input B) based on a control signal (S), and of outputting (output Y). Note that the control signal is externally input, similarly to the input signals of the switch 36 and the selection section 16. Whichever of the clock signals (clk or clk2) is output from the multiplexer 26, this clock signal is halved in frequency by a D flip flop circuit 28 and supplied to the D flip flop circuits 48 of the output circuit 34. Namely, when loading RSDS format data, the clock signal clk2 of half the frequency of the reference clock signal clk for RSDS format is supplied to the D flip flop circuits 48. However, when loading mini-LVDS format data, the clock signal clk4 of a quarter the frequency of the reference clock signal clk for mini-LVDS format is supplied to the D flip flop circuits 48.

As illustrated in FIG. 2, in the semiconductor device 10 of the present exemplary embodiment, the input section 12, the holding section 14, the selection section 16, the output section 18 and each of the D flip flop circuits (42, 44, 48) are laid out with line symmetry with the clock signal supply section 24 as the axis of symmetry.

As illustrated in FIG. 2 and FIG. 3, in the semiconductor device 10 of the present exemplary embodiment, the D flip flop circuits (42, 44, 48) of the respective input section 12, holding section 14, and output section 18 (output circuit 34) are connected in a multi-stage bifurcated style layout that enables two types of data to be output at the same time. For example, when loading RSDS format data, each of the D flip flop circuits 42 of the input section 12 is connected to twice as many (2) of the respective D flip flop circuits 48 of the output circuit 34, and each of the D flip flop circuits 48 outputs data to twice that number again of output destinations. Namely, in the semiconductor device 10, data input from a single terminal 40 is output as 4 data signals.

When the D flip flop circuits 42 are loading mini-LVDS format data, each of the D flip flop circuits 42 of the input section 12 is connected to twice as many (2) of the D flip flop circuits 44 of the holding section 14, each of the D flip flop circuits 44 is connected to twice that number again of the D flip flop circuits 48 of the output circuit 34, and each of the D flip flop circuits 48 outputs data to twice that number again of output destinations. Namely, in the semiconductor device 10, data input from a single input terminal 40 is output as 8 data signals.

Explanation follows regarding operation of the semiconductor device 10 of the present exemplary embodiment.

First, explanation is given regarding operation when the semiconductor device 10 is functioning as an RSDS interface, namely, when the input data is RSDA format data. Note that in the interests of simplicity, the following explanation concerns operation corresponding to monochromatic data (8-bit×2 pixels).

Figure 4:
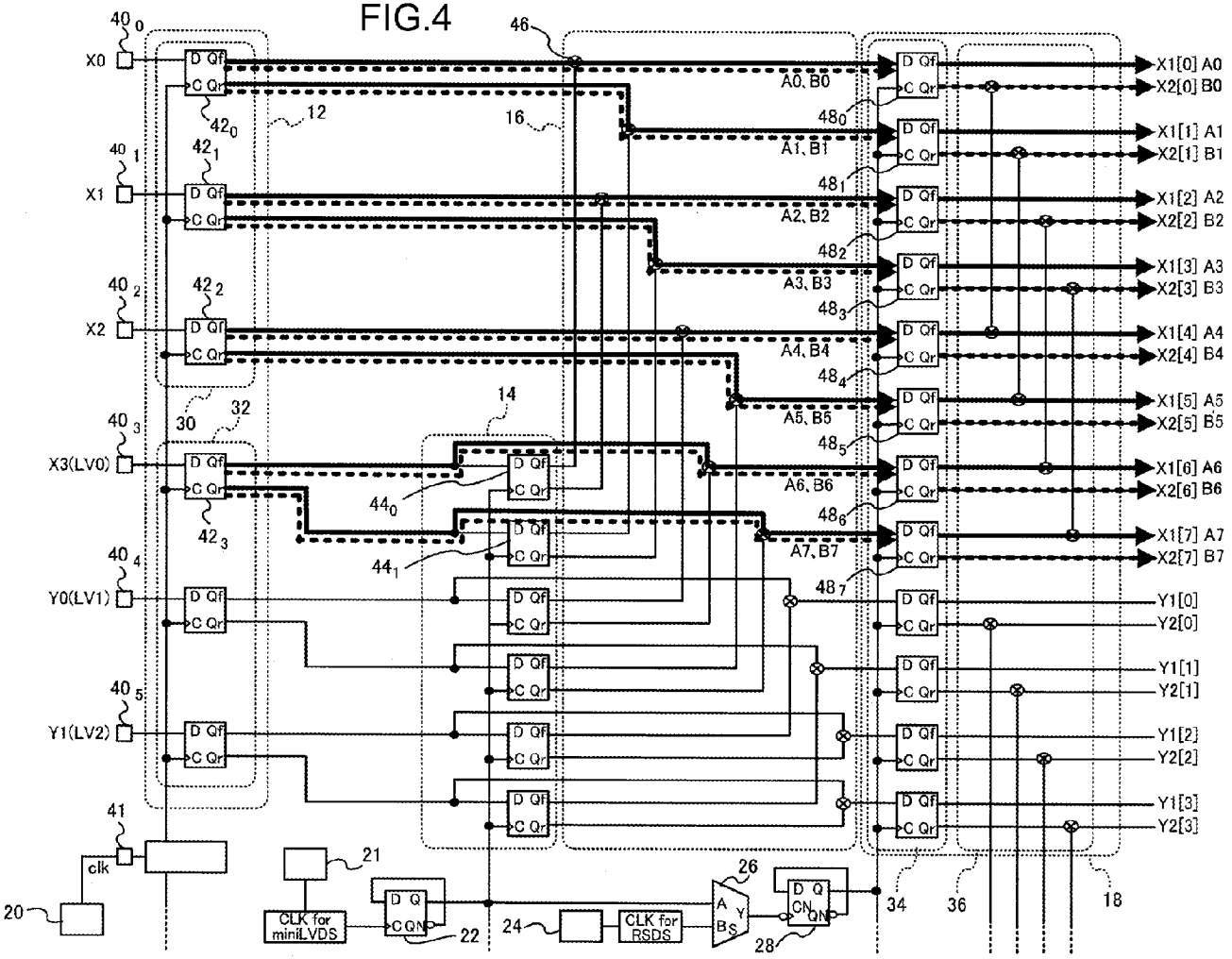
FIG. 4 is a circuit diagram illustrating a flow of RSDS format data in a semiconductor device of the present exemplary embodiment.
Figure 5:
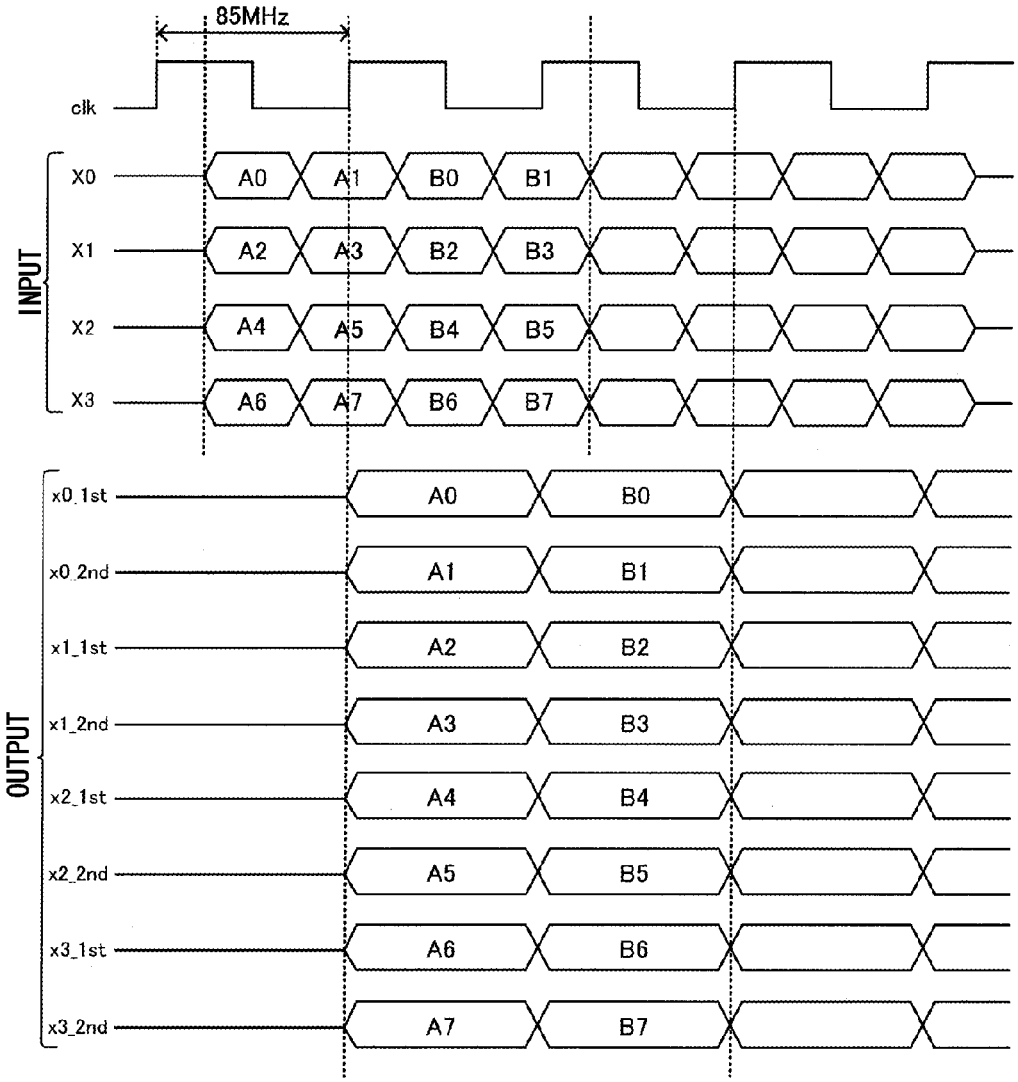
FIG. 5 is a timing chart of input data and output data in an input section of a semiconductor device of the present exemplary embodiment.
Figure 6:
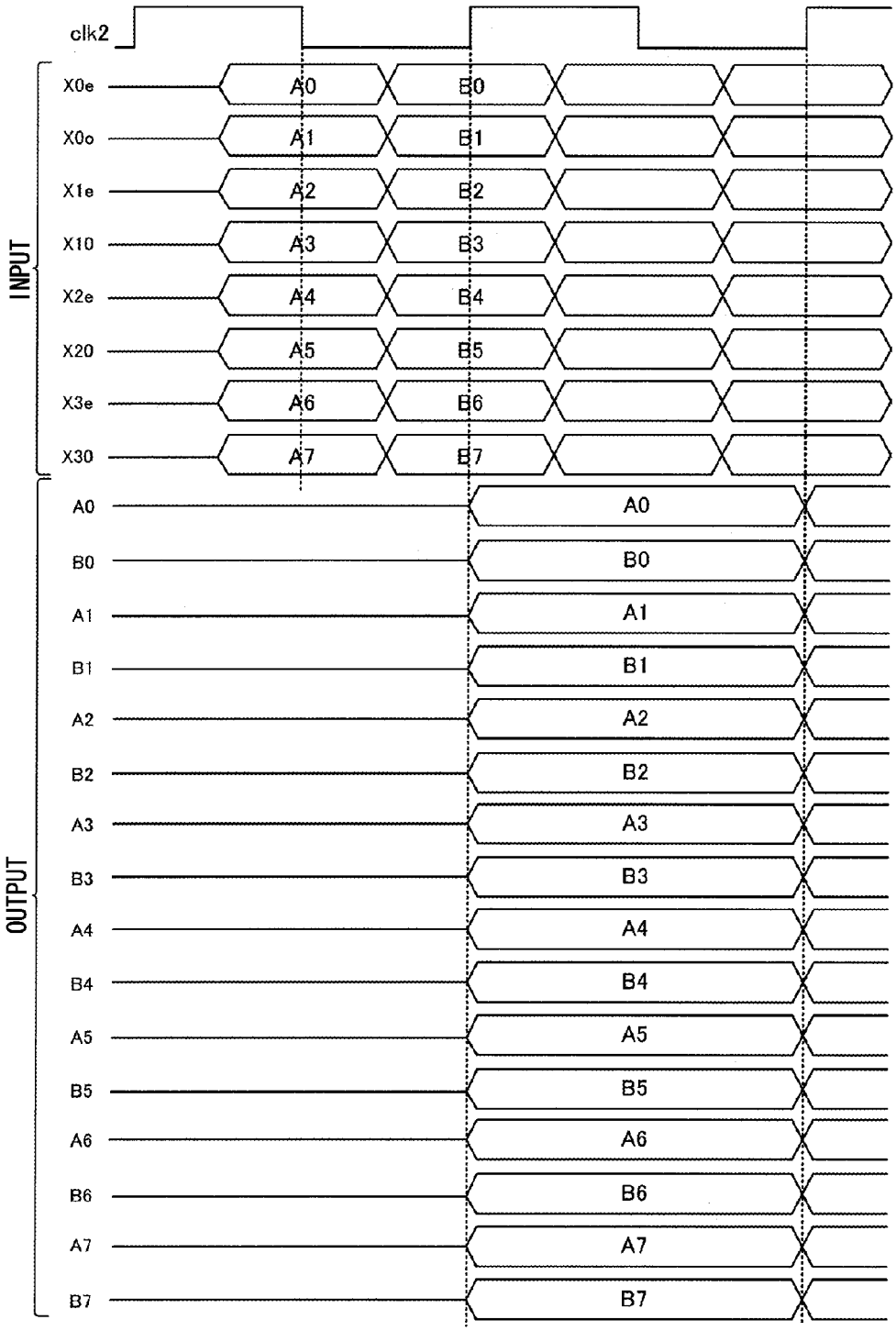
FIG. 6 is a timing chart of input data and output data in an output section of a semiconductor device of the present exemplary embodiment.

FIG. 4 is a circuit diagram illustrating an example of a flow of RSDS format data. FIG. 5 is a timing chart illustrating an example of input data and output data of the input section 12. FIG. 6 is a timing chart illustrating an example of input data and output data of the output section 18.

The reference clock signal clk for RSDS format is input to the terminal 41 from the clock signal supply section 20. In the present exemplary embodiment, as a specific example, the reference clock signal clk for RSDS format has a frequency of 85 MHz. The D flip flop circuits 48 of the output circuit 34 are supplied with the clock signal clk2 of half the frequency of the reference clock signal clk supplied from the clock signal supply section 24.

As illustrated in FIG. 5, the D flip flop circuits 42 of the input section 12 loaded data at the falling edge of the reference clock signal clk that has been input from the terminal 41, and then output the loaded data from an output Qf at the next rising edge. The D flip flop circuits 42 moreover loaded data at the rising edge of the reference clock signal clk that has been input from the terminal 41, and output the loaded data from an output Qr at the same rising edge. The selection section 16 selects the output data that has been output from the input section 12 and outputs the selected data to the output circuit 34.

As illustrated in FIG. 6, the D flip flop circuits 48 of the output circuit 34 of the output section 18 load the data input from the input section 12 at the falling edge of the clock signal clk2, and output the loaded data from an output Qf at the next rising edge. The D flip flop circuits 48 moreover load the data input from the input section 12 at the rising edge of the clock signal clk, and output the loaded data from an output Qr at the same rising edge. When loading RSDS format data, the switch 36 does not operate, and the output destination of the output data is not switched.

Explanation is now given focusing on data input to one specific terminal 40. Data A0, A1 is input to X0 (terminal $\mathbf{40}_0$). The D flip flop circuit 42 loads the data A0 at the falling edge of the reference clock signal clk, and then loads the data A1 at the next rising edge of the reference clock signal clk and outputs the data A0 and the data A1 at the same time. The data A0 (output data x0_1st) is output to the D flip flop circuit $\mathbf{48}_0$ of the output circuit 34. The data A1 (output data x0_2nd) is output to the D flip flop circuit $\mathbf{48}_1$ of the output circuit 34.

The data A0 and data B0 are thus input to the D flip flop circuit $\mathbf{48}_0$. As illustrated in FIG. 6, the D flip flop circuit $\mathbf{48}_0$ loads the data A0 at the falling edge of the clock signal clk2, and loads the data B0 at the rising edge, and outputs the data A0 and the data B0 at the same time. When this is performed, the data A0 is output to X1 [0] and the data B0 is output to X2 [0], since the output destination is not switched by the switch 36.

Note that in the present exemplary embodiment, when loading RSDS format data, operation of the holding section 14 is stopped. Stopping operation in this manner enables the current consumption to be reduced.

Next, explanation follows regarding operation when the semiconductor device 10 is functioning as a mini-LVDS interface, that is to say, when the input data is mini-LVDS format data. Note that in the interests of simplicity, similarly to the case of the RSDS format, the following explanation concerns operation corresponding to monochromatic data (8-bit×2 pixels).

Figure 7:
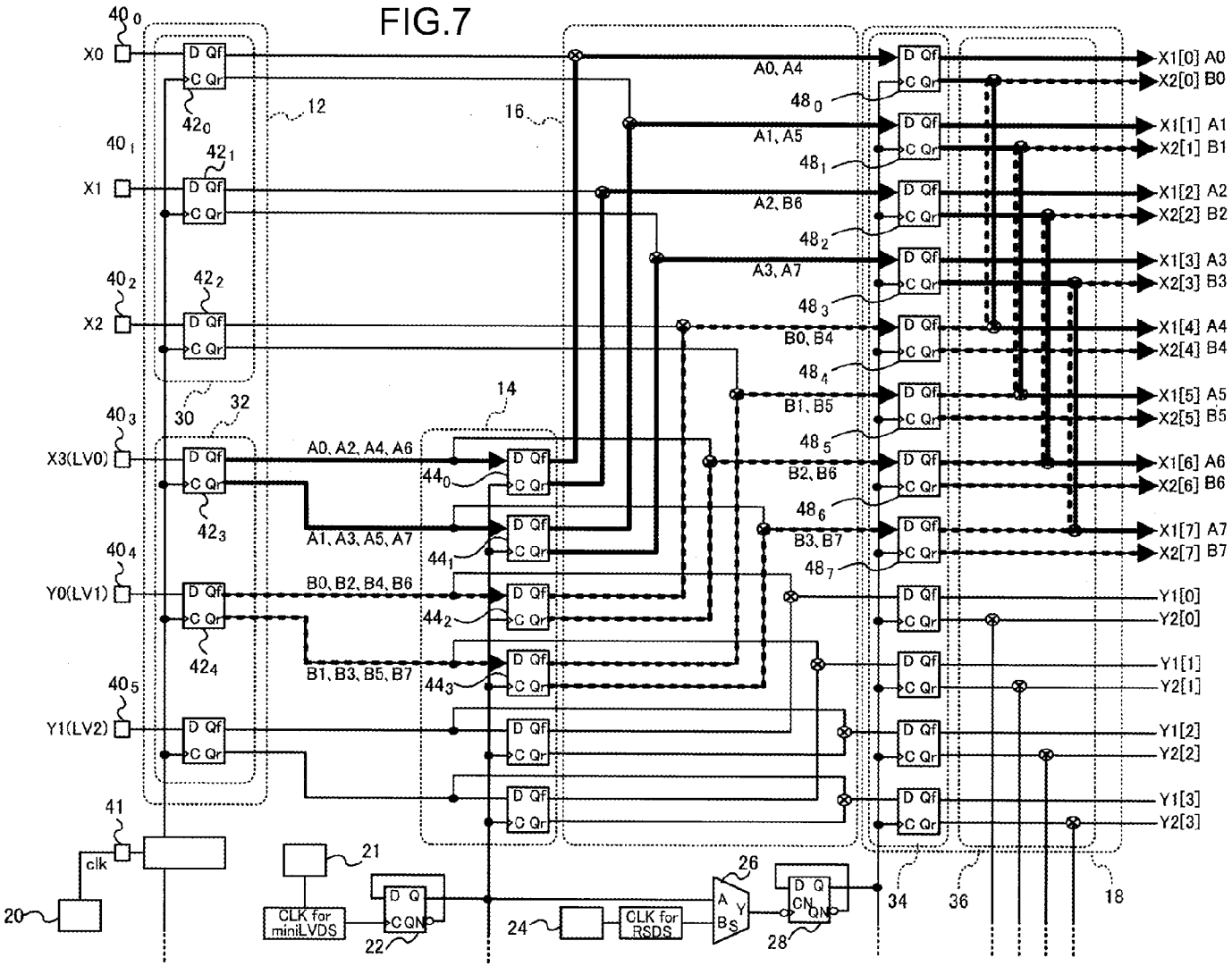
FIG. 7 is a circuit diagram illustrating a flow of mini-LVDS format data in a semiconductor device of the present exemplary embodiment.
Figure 8:
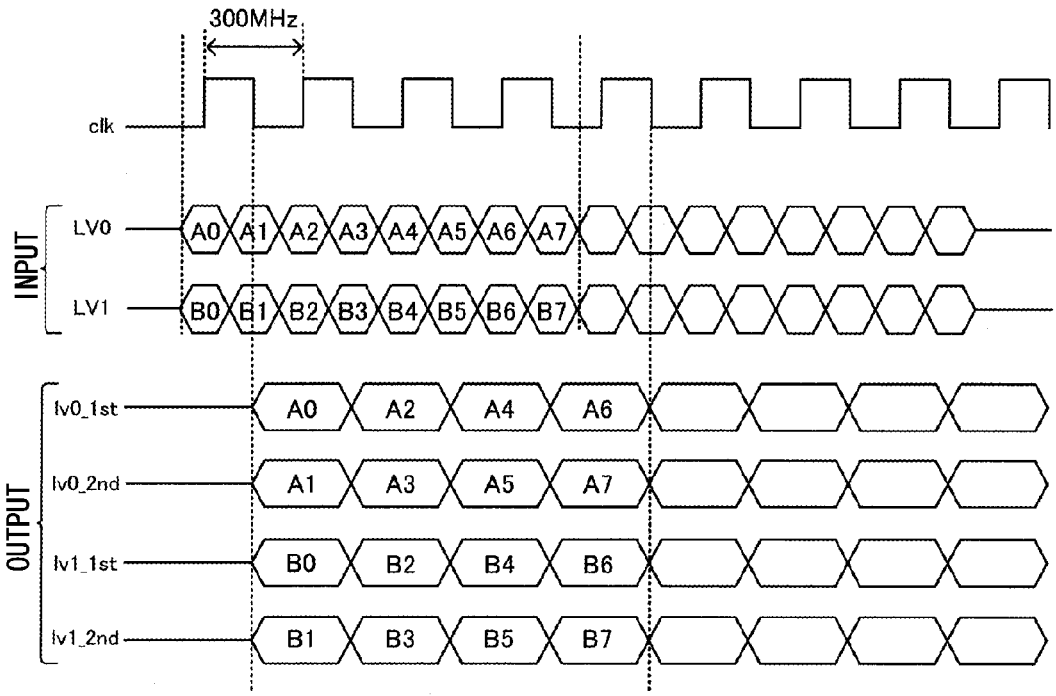
FIG. 8 is a timing chart of input data and output data in an input section of a semiconductor device of the present exemplary embodiment.
Figure 9:
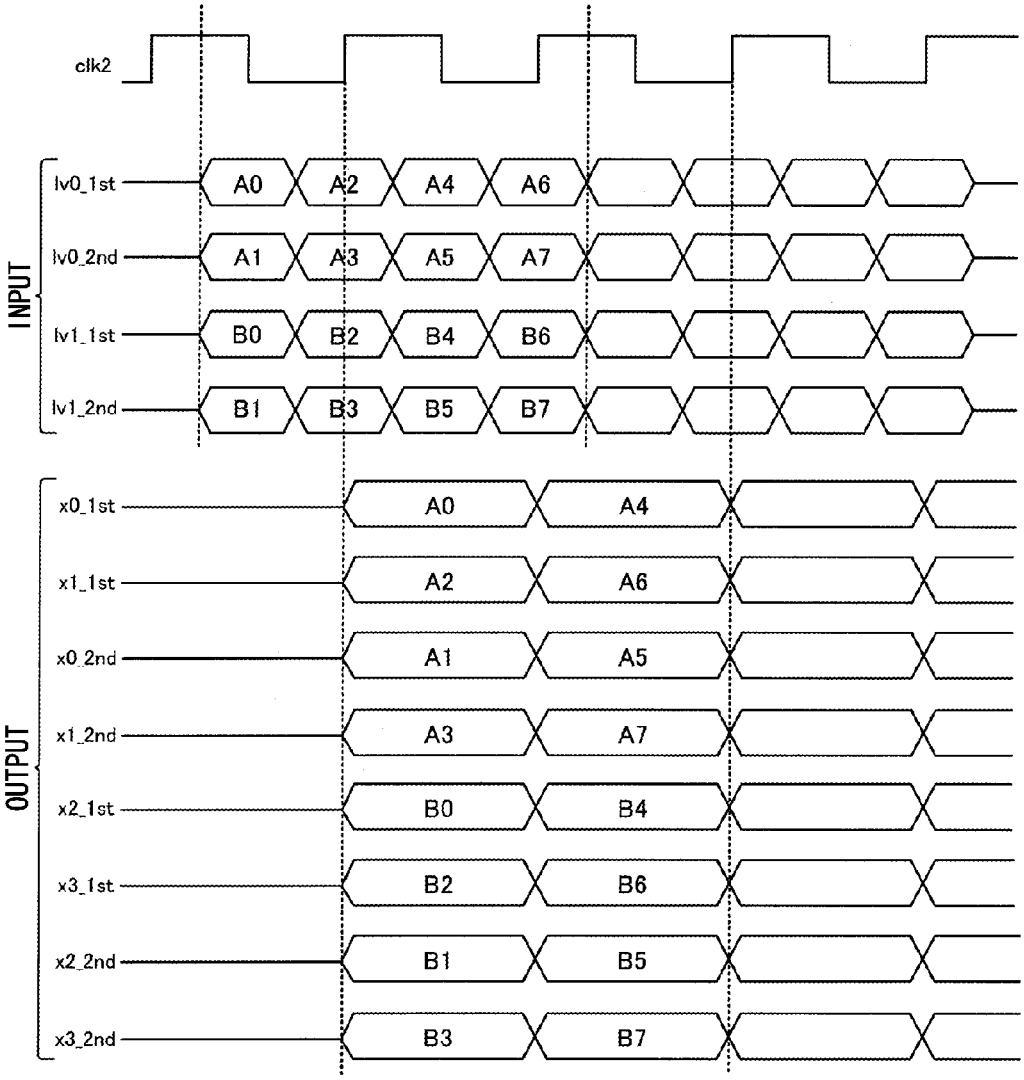
FIG. 9 is a timing chart of input data and output data in a holding section of a semiconductor device of the present exemplary embodiment.
Figure 10:
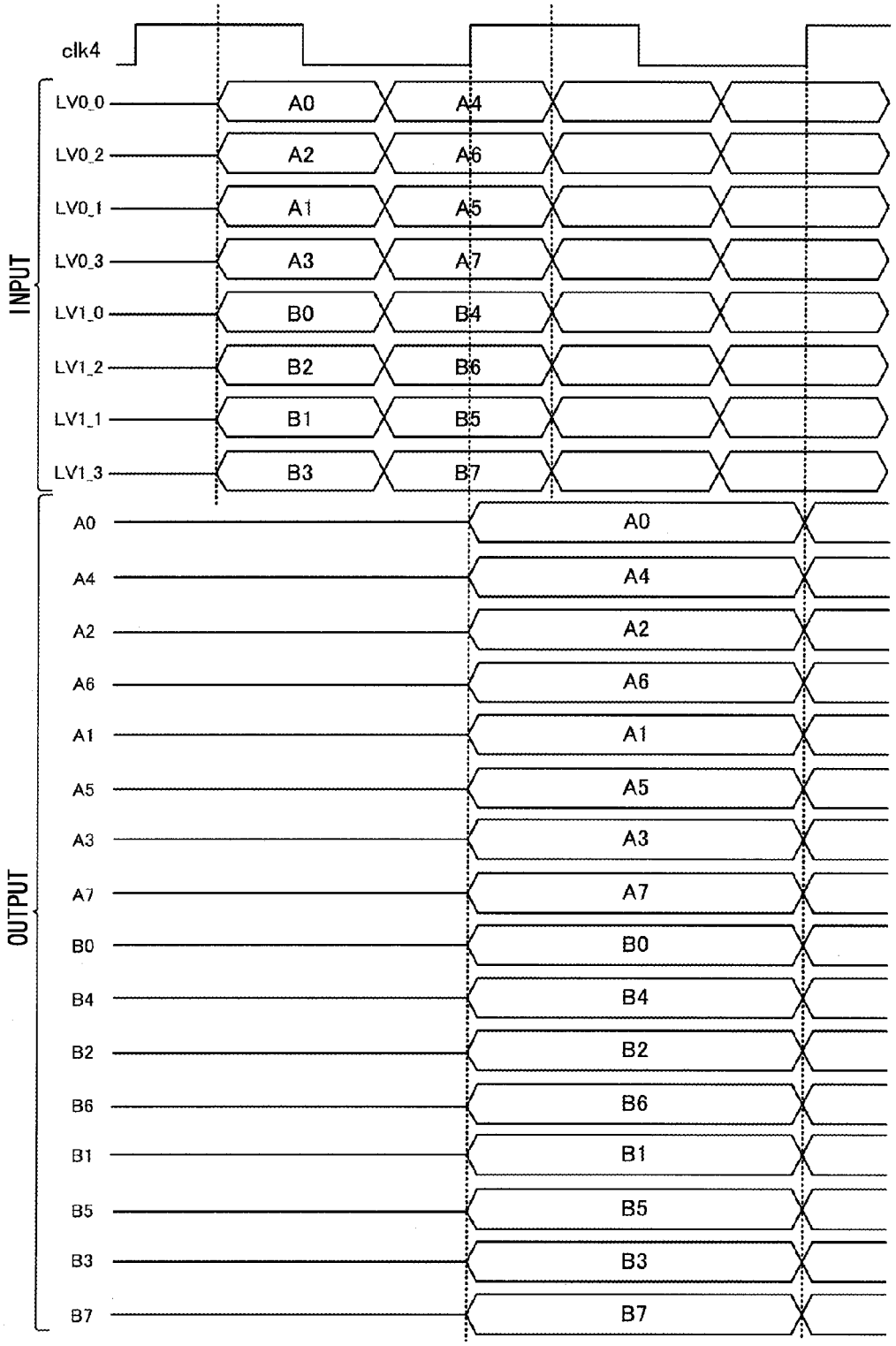
FIG. 10 is a timing chart of input data and output data in an output section of a semiconductor device of the present exemplary embodiment.

FIG. 7 is a circuit diagram illustrating an example of a flow of mini-LVDS format data. FIG. 8 is a timing chart illustrating an example of input data and output data of the input section 12. FIG. 9 is a timing chart illustrating an example of input data and output data of the holding section 14. FIG. 10 is a timing chart illustrating an example of input data and output data of the output section 18.

The reference clock signal clk for mini-LVDS format is input to the terminal 41 from the clock signal supply section 20. In the present exemplary embodiment, as a specific example, the reference clock signal clk for mini-LVDS format has a frequency of 300 MHz. The D flip flop circuits 44 of the holding section 14 are supplied with the clock signal clk2 of half the frequency of the reference clock signal clk supplied from the clock signal supply section 21. The D flip flop circuits 48 of the output circuit 34 are supplied with the clock signal clk4 of half the frequency of the clock signal clk2 (a quarter the frequency of the reference clock signal).

As illustrated in FIG. 8, the D flip flop circuits 42 of the input section 12 load the data input at the rising edge of the reference clock signal clk input from the terminal 41, and then output the loaded data from the output Qf to the holding section 14 at the next falling edge. The D flip flop circuits 42 load the data at the falling edge of the reference clock signal clk input from the terminal 41, and output the loaded data from the output Qr to the holding section 14 at the same falling edge. Note that, in the present exemplary embodiment, the clock signal clk2 and the clock signal clk4 are respectively generated by frequency-dividing the reference clock signal clk. The D flip flop circuits 42 therefore output the loaded data at the falling edges in consideration of the data loading timing of the holding section 14. Note that there is no such limitation when the clock signal clk2 and the clock signal clk4 are not generated by dividing the reference clock signal clk. For example, in a case in which the clock signal clk2 and the clock signal clk4 are supplied to the semiconductor device 10 from separate clock signal supply section(s), the D flip flop circuits 42 may output loaded data at the rising edges.

As illustrated in FIG. 9, the D flip flop circuits 44 of the holding section 14 load the data input from the input section 12 at the falling edge of the clock signal clk2, and output the loaded data from an output Qf to the output section 18 at the next rising edge. The D flip flop circuits 44 moreover load the data input from the input section 12 at the rising edge of the clock signal clk2, and output the loaded data from an output Qr to the output section 18 at the same rising edge.

The selection section 16 selects the output data from the holding section 14 and outputs the selected data to the output circuit 34.

As illustrated in FIG. 10, the D flip flop circuits 48 of the output circuit 34 of the output section 18 load the data input from the holding section 14 at the falling edge of the clock signal clk4, and output the loaded data from the output Qf at the next rising edge. Moreover, the D flip flop circuits 48 load the data input from the holding section 14 at the rising edge of the clock signal clk4, and output the loaded data from the output Qr at the same rising edge. When loading mini-LVDS format data, the switch 36 is operated to switch the output destinations of the output data, rearranging the data into a desired sequence.

Explanation is now given focusing on data input to one specific terminal 40. Data A0, A1 is input to LV0 (terminal $\mathbf{40}_3$). The D flip flop circuit 42 loads the data A0 at the rising edge of the reference clock signal clk, and then loads the data A1 at the next falling edge of the reference clock signal clk and outputs the data A0 and the data A1 at the same time. The data A0 (output data lv0_1st) is output to the D flip flop circuit $\mathbf{44}_0$ of the holding section 14. The data A1 (output data lv0_2nd) is output to the D flip flop circuit $\mathbf{44}_1$ of the holding section 14.

Data A0, A2, A4 and data A6 are thus input to the D flip flop circuit $\mathbf{44}_0$. As illustrated in FIG. 9, the D flip flop circuit $\mathbf{44}_0$ loads the data A0 at the falling edge of the clock signal clk2, and then loads the data A2 at the rising edge and outputs the data A0 and the data A2 at the same time. The data A0 is output to the D flip flop circuit $\mathbf{48}_0$ of the output circuit 34, and the data A2 is output to the D flip flop circuit $\mathbf{48}_2$ of the output circuit 34.

The data A0 and the data A4 are thus input to the D flip flop circuit $\mathbf{48}_0$. As illustrated in FIG. 10, the D flip flop circuit $\mathbf{48}_0$ loads the data A0 at the falling edge of the clock signal clk4, and then loads the data A4 at the rising edge and outputs the data A0 and the data A4 at the same time. When this is performed, since the switch 36 switches the output destinations, the data A0 and A4 are output to X1[0] and X1[4], respectively.

As described above, the semiconductor device 10 of the present exemplary embodiment includes the input section 12, the holding section 14, the selection section 16, and the output section 18. Further, the input section 12 includes the first input circuit 30 and the second input circuit 32. When loading RSDS format data, the selection section 16 selects the data output from the input section 12 and outputs the selected data to the output section 18, and when loading mini-LVDS format data, data that has been output from the input section 12 and first held by the holding section 14 is then selected by the selection section 16 and output to the output section 18. When loading mini-LVDS format data, the output destinations are switched by the switch 36 of the output section 18, thereby externally outputting (to a later stage circuit of the semiconductor device 10) data that has been rearranged into a desired sequence.

The semiconductor device 10 is accordingly capable of functioning as an interface for different differential formats (RSDS format and mini-LVDS format). Moreover, both circuit redundancy and circuit surface area can be suppressed in comparison to a case in which both an interface for loading RSDS format data and an interface for loading mini-LVDS format data are separately provided.

In the semiconductor device 10 of the present exemplary embodiment, the clock signal supply section 20 and the clock signal supply section 21 that supply the clock signal clk for mini-LVDS are different to the clock signal supply section 24 that supplies the clock signal clk for RSDS. The clock signal supply section 20 and the clock signal supply section 21 may therefore be disposed in the vicinity of the terminal 41 or the terminal 40, and the clock signal supply section 24 may be disposed in the vicinity of an internal circuit. The input section 12 and the holding section 14 of the present exemplary embodiment operate at a high speed clock, and the output section 18 operates at a lower speed clock than the input section 12 and the holding section 14. Thus, in the circuits that operate at a lower speed clock, it may be possible to relax dimensional standards of internal circuits, and to raise margins for manufacturing variation.

Moreover, the semiconductor device 10 of the present exemplary embodiment has a multi-stage bifurcated circuit configuration with the clock signal supply section 21 and the clock signal supply section 24 disposed at the center of the circuit block, enabling a symmetrical layout may be achieved, and facilitating design work.

In each of the exemplary embodiments described above, explanation has been given regarding a case in which the input signals of differential input formats input to the semiconductor device 10 are RSDS format input signals and mini-LVDS format input signals. However, there is no limitation thereto and configuration may be made with other input signals. Moreover in each of the exemplary embodiments described above explanation has been given regarding a case using 8-bit data for each color, however the number of bits of data and the number of sub-pixels are not limited thereto. There is moreover no limitation to image data for the data input to the semiconductor device 10.

In the semiconductor device 10 of the present exemplary embodiment, the input section 12, the holding section 14, and the selection section 16 may be mounted on the same chip as the output section 18, or the output section 18 may be mounted on a separate chip.

Moreover, configurations, operation and the like explained in each of the exemplary embodiments described above for the semiconductor device 10, the input section 12, the holding section 14, the selection section 16 and the output section 18 are merely examples thereof, and obviously modifications may be made thereto as required within a range not departing from the spirit of the present invention.

What is claimed is:

1. A drive IC that outputs to a display panel a signal generated based on image data, the drive IC comprising:

an input section that is input with one of a first differential signal or a second differential signal different than the first differential signal, and configured to load the input first differential signal or the input second differential signal according to a first clock signal and output the loaded differential signal;

a holding section configured to receive and load only the first differential signal output from the input section according to a second clock signal, and hold and then output the held loaded signal;

an output section configured to load the first differential signal or the second differential signal according to a third clock signal and output the loaded signal;

a selection section configured to select and output the first differential signal as provided from the holding section to the output section, in which the first differential signal has been input to the input section, and select and output the second differential signal as provided from the input section to the output section, in a case in which the second differential signal has been input to the input section; and a clock signal supply section configured to supply to the output section the third clock signal corresponding to the first differential signal or the second differential signal that has been input to the input section.

2. The drive IC of claim 1, wherein the input section comprises:

a first input circuit configured to load the first differential signal and output the loaded first differential signal as the loaded differential signal; and a second input circuit configured to load the first differential signal or the second differential signal and output the loaded first differential signal or the loaded second differential signal as the loaded differential signal.

3. The drive IC of claim 1, wherein the input section is configured to load one of the first differential signal or the second differential signal input according to a first transition and a second transition in a level of the first clock signal, and according to one of the first transition or the second transition of the first clock signal output the first differential signal or the second differential signal loaded according to the first transition and the second transition of the first clock signal as the loaded differential signal, and wherein the holding section is configured to load the first differential signal according to the first transition and the second transition in a level of the second clock signal, and according to one of the first transition or the second transition in the level of the second clock signal output the first differential signal loaded at the first transition and the second transition as the held loaded signal.

4. The drive IC of claim 1, wherein the output section comprises:

an output circuit configured to load the first differential signal or the second differential signal according to the third clock signal and output the loaded signal; and a switch configured to switch the output destination of the output circuit.

5. The drive IC of claim 1, wherein the second clock signal and the third clock signal are lower speed clocks than the first clock signal.

6. The drive IC of claim 1, wherein the input section, the holding section, and the output section are configured in a multi-stage bifurcated layout having a greater number of outputs of the output section than a number of outputs of the input section.

7. The drive IC of claim 1, wherein the input section, the holding section, and the output section comprise a plurality of flip flop circuits configured to hold and output data, the plurality of flip flop circuits disposed with line symmetry about an axis of the clock signal supply section.

8. The drive IC of claim 1, wherein the first differential signal is a signal based on a mini-LVDS input format.

9. The drive IC of claim 1, wherein the second differential signal is a signal based on an RSDS input format.

10. A display device comprising:

a display panel;

the drive IC of claim 1 configured to output to the display panel the signal generated based on the image data that is the loaded first differential signal or the loaded second differential signal; and a timing controller configured to instruct the drive IC regarding loading of the image data.

11. The display device of claim 10, wherein a number of outputs of the first differential signal and the second differential signal output from the output section of the drive IC is a multiple of 2× a number of sub-pixels of the display panel.

12. A signal loading method comprising:

inputting, by an input section, one of a first differential signal or a second differential signal different than the first differential signal, and loading the input first differential signal or the input second differential signal according to a first clock signal and outputting the loaded differential signal;

loading, by a holding section, only the first differential signal output from the input section according to a second clock signal, and holding and then outputting the held loaded signal;

selecting, by a selection section, for output to an output section the first differential signal output from the holding section in a case in which the first differential signal has been input to the input section, and selecting for output to the output section the second differential signal that has been output from the input section in a case in which the second differential signal has been input to the input section, wherein the output section loads the first differential signal or the second differential signal according to a third clock signal and outputs the loaded signal; and supplying, by a clock signal supply section, the third clock signal corresponding to the first differential signal or the second differential signal that has been input to the input section to the output section.

* * * * *